US005971333A

United States Patent [19]

Fiedor

[11] Patent Number: 5,971,333

[45] Date of Patent: Oct. 26, 1999

[54] MOVABLE SELF SUPPORTING IMPLEMENT STAND AND CONVERTIBLE BUCKET EXTERNAL FRAME

[76] Inventor: Joseph E. Fiedor, 5179 Selma Ave., Fremont, Calif. 94536-7226

[21] Appl. No.: 08/943,686

[22] Filed: Oct. 3, 1997

[51] Int. Cl.[6] ..... A47K 1/04

[52] U.S. Cl. ..... 248/129; 280/47.35; 211/70.6; 206/373

[58] Field of Search ..... 248/129, 128, 248/132, 524; 280/47.35, 47.19, 29.5; 206/373; 211/20.6, 70.2, 70.6

[56] References Cited

U.S. PATENT DOCUMENTS

| | | | |
|---|---|---|---|
| 118,451 | 8/1871 | Harris | 211/65 |
| 1,662,091 | 3/1928 | Vuozzo | 248/524 |
| 2,665,922 | 1/1954 | Bard | 248/129 |
| 3,298,531 | 1/1967 | Wilcke | 211/70.6 |
| 3,731,333 | 5/1973 | Davis | 15/257 |
| 3,759,538 | 9/1973 | Fabiano | 280/47.35 |
| 3,883,150 | 5/1975 | Varela | 280/47.19 |
| 4,350,366 | 9/1982 | Helms | 280/655 |
| 4,826,007 | 5/1989 | Skeie | 206/373 |
| 4,947,998 | 8/1990 | Smeller | 211/70.6 |
| 5,092,463 | 3/1992 | Dees | 206/373 |
| 5,183,280 | 2/1993 | Gresch | 280/79.5 |
| 5,188,243 | 2/1993 | Ruiz | 211/70.2 |
| 5,350,065 | 9/1994 | Darrey | 206/373 |
| 5,390,944 | 2/1995 | Sherwin | 280/47.35 |

*Primary Examiner*—Leslie A. Braun
*Assistant Examiner*—Tan Le
*Attorney, Agent, or Firm*—James P. Hillman

[57] ABSTRACT

A movable self supporting tool implement stand having a separation means for separating, holding and storing tool implements in the vertical position and a mobility means for permitting desired movement of the implement stand to, from and across a work area. The invention accomplishes this by comprising an outer peripheral shell frame and an inner fixed tubular frame having top and bottom surfaces disposed thereon. The outer peripheral shell frame may be a cylindrical bucket and the inner fixed tubular frame is completely removable therefrom to provide a free standing movable self supporting tool implement stand with a separate free standing bucket that may be used at the job sight.

1 Claim, 3 Drawing Sheets

MOVABLE SELF SUPPORTING IMPLEMENT STAND AND CONVERTIBLE BUCKET EXTERNAL FRAME

BACKGROUND OF THE INVENTION

1. Field of the Invention

The invention relates in general to an implement stand and in particular to a self supporting tool implement stand having a separation means for separating, holding and storing tool implements in the vertical position and a mobility means for permitting desired movement of the implement stand to, from and across a work area.

2. Description of the Related Art

Tool holders are well known in the art. Various designs and configurations are readily available on the market for use on vertical walls, tool benches, tool boxes, display boards, truck cabs/beds and other fixed structures. Usually such tool holders either hold the tool face, head or the handle in a rigid mechanical grip that firmly affixes the tool to the supporting structure.

Usually the tool holders of the related art are mounted on a supporting structure that is fixed also, but often times is movable as in the case of display boards and truck cabs/beds. When the tool holder of the related art is mounted on a movable structure, the tool holder with affixed tools may be moved with the structure. This works well for moving a display to alternate locations. And of course truck mounted tool holders have mobility limited only by egress of the supporting truck. But for everyone else that work with fixed tool holders, the affixed tools must be removed from the fixed tool holder and transported to the job sight by hand carrying or by using a transport means such as for instance a wheelbarrow, or wagon. When such a transport means is utilized, oftentimes the tool implements are in complete disarray by the time they reach the job sight.

Accordingly it would be desirable to have a tool implement stand having a holding/separation means for separating, holding and storing tool implements in the vertical position and a mobility means for permitting desired movement of the implement stand to, from and across a work area. Further it would be desirable if such an implement stand utilized a bucket for an external frame that could be converted into a stand alone bucket for use on the job sight.

SUMMARY OF THE INVENTION

Briefly the invention is directed to a movable self supporting tool implement stand having a separation means for separating, holding and storing tool implements in the vertical position and a mobility means for permitting desired movement of the implement stand to, from and across a work area. The invention accomplishes this by comprising an outer peripheral shell frame having top and bottom surfaces disposed thereon. The top surface has multiple openings disposed therein sized to receive elongated shafts such as for instance the handles of tools, toys, sporting goods or other various sundry implement elongated shafts. A multiplicity of tubular isolation means are disposed between the top and bottom surfaces. Such tube means are sized to conform to the multiple openings disposed in the top surface and are rigidly retained between the top and bottom surfaces so as to extend between the top and bottom surfaces in a longitudinal direction. The bottom surface has wheels rotatably disposed on axles that are attached to the underside of the bottom surface at spaced intervals to provide mobility to the implement stand of the invention. Preferred embodiments of the invention include making the outer shell and top and bottom surfaces out of a suitable rigid material such as high density plastic. Preferred embodiments of the invention also provide for the top and bottom surfaces being in the horizontal direction or plane and the tubular isolation means being disposed in the vertical orientation to provide for supporting the tool elements likewise in the vertical position. A further preferred embodiment of the invention uses a rigid plastic bucket as the outer cylindrical shell with the top and bottom surfaces sized so as to provide a slip grip attachment to the cylindrical shell of the bucket so that the implement stand may be slipped out of the stand alone bucket and the bucket used at the job sight. Further, the bottom surface is sized to provide a slip grip with a bottom platform having the wheels disposed thereon so that when the implement stand is removed from the stand alone bucket, the implement stand may be inserted into the bottom platform and transported. In this manner the implement stand is fully mobile, with or without the stand alone bucket outer cylindrical shell present.

BRIEF DESCRIPTION OF THE DRAWINGS

The invention may be understood and further advantages and uses thereof more readily apparent, when considered in view of the following detailed description of the exemplary embodiments, taken with the accompanying drawings in which.

DESCRIPTION OF THE PREFERRED EMBODIMENTS

Figure 1:
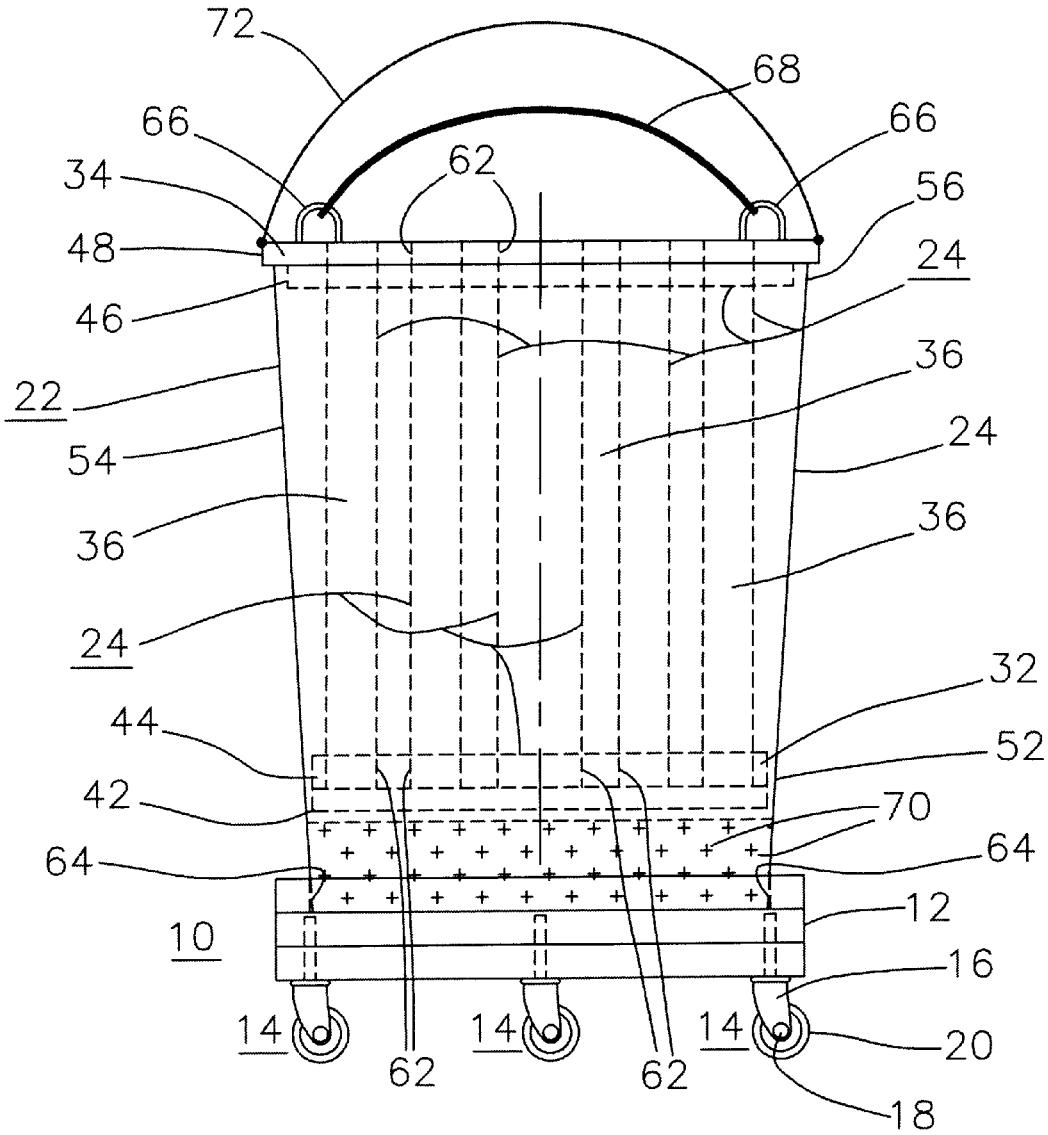
FIG. 1 is an elevational front view of the tool implement stand constructed according to the teachings of the invention.

Referring now to the drawings and to FIG. 1 in particular there is shown an elevational front view of the tool implement stand 10 constructed according to the teachings of the invention. Tool implement stand 10 includes base 12 having swivel roller wheels 14 including swivel 16, axle 18 and wheel 20. Base 12 supports outside cylindrical shell frame 22 which according to the teachings of the invention, may be a five gallon stand alone bucket made from any suitable material, such as for instance plastic, rubber or a composite material. Disposed inside cylindrical shell frame or bucket 22 is inside fixed frame 24 including bottom plate 32, top plate 34 and elongated tubes 36, which may be for instance schedule 100? PVC poly vinyl chloride tubing. Both bottom plate 32 and top plate 34 have lower and upper portion 42, 44(lower plate 32) and 46, 48 (top plate 34), respectively. Lower portion 42 of lower plate 12 fits snugly within the bottom portion 52 of cylindrical shell sidewall 54 of cylindrical shell frame 22. Likewise lower portion 46 of upper plate 34(shown with a clearance for purposes of illustration in FIG. 1) fits snugly within the top portion 56 of cylindrical shell sidewall 54 of cylindrical shell frame 22. This snug fit results because cylindrical shell sidewall 54 is disposed at an oblique angle with the horizontal, whereas both lower portions 42, 46 of upper and lower plates 32, 34 respectively form 90° angles with the horizontal. Upper portion 44 of lower plate 32 and both upper and lower portions 46, 48 respectively, of upper plate 34 are formed with openings 62 for receiving elongated tubes 36, which may be attached by press fit, adhesive and other standard attachment means known to the art.

Figure 2:
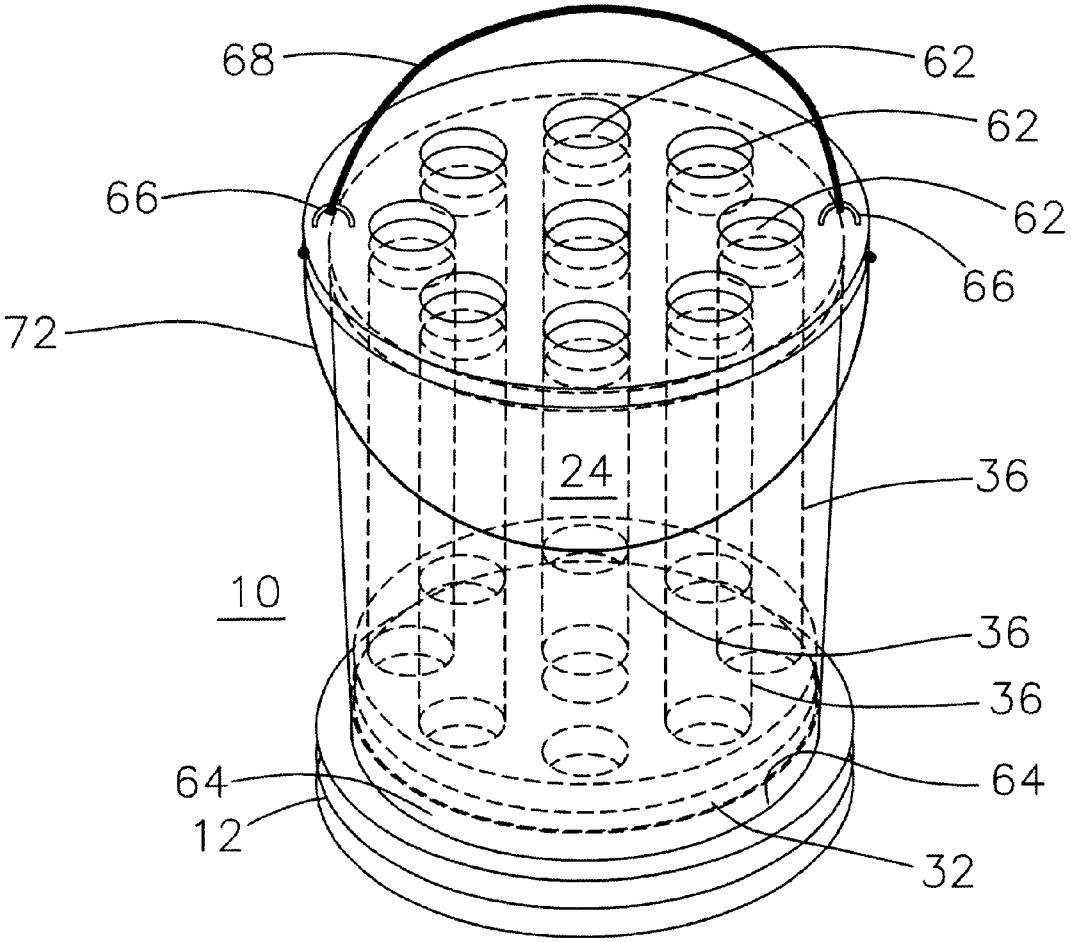
FIG. 2 is an isometric view of the tool implement stand of FIG. 1 with the wheels removed.
Figure 3:
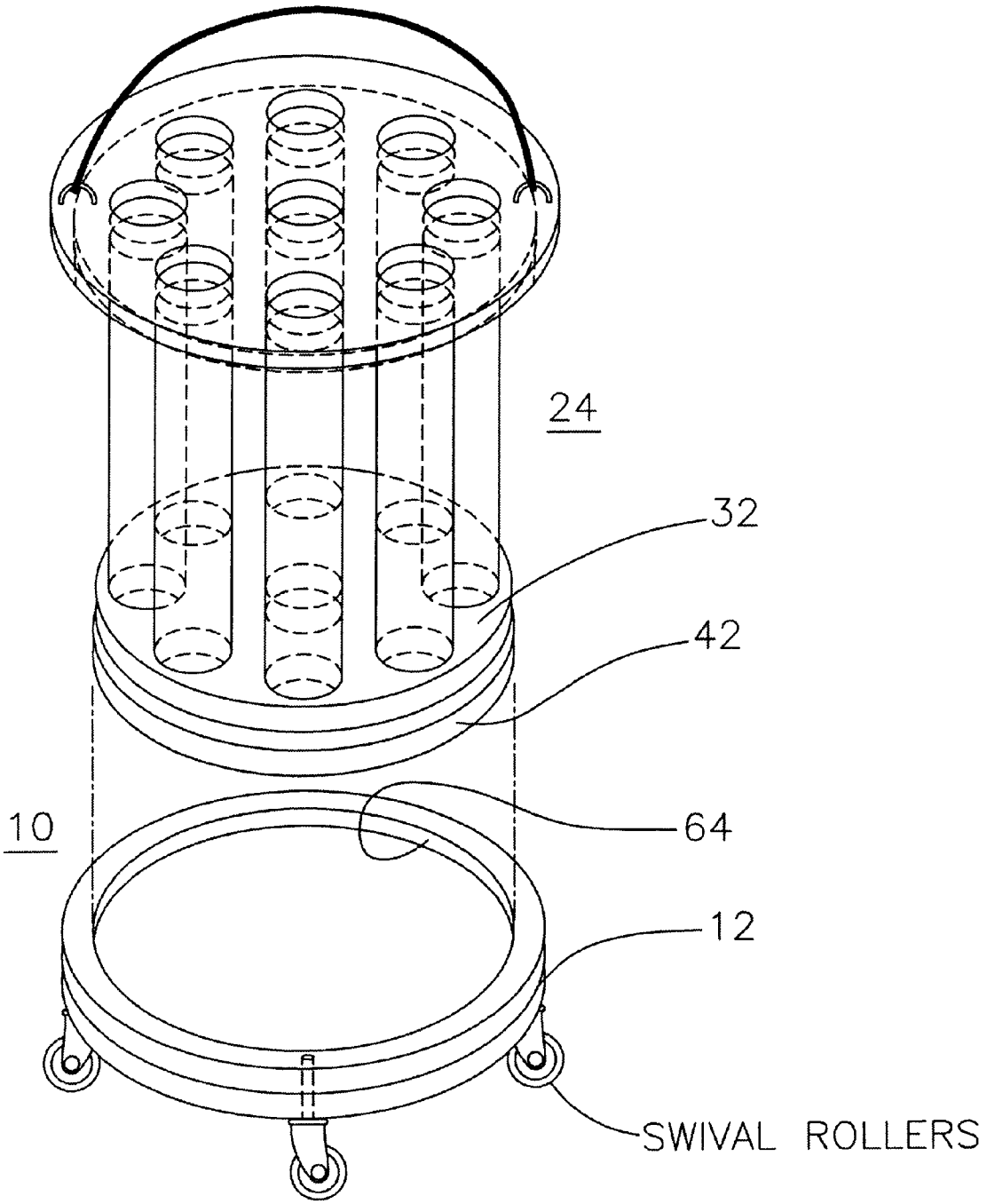
FIG. 3 is an isometric view of the base of the tool implement stand of FIG. 1 with the fixed internal frame implement stand removed from the bucket cylindrical external frame and positioned above the base, all constructed according to the teachings of the invention.

Referring now to FIG. 2 there is shown an isometric view of the tool implement stand of FIG. 1 with the wheels removed illustrating how outer cylindrical shell frame or bucket 22 is removable and replaceable within base 12 of tool implement stand 10. Also illustrated in FIG. 3 is how openings 62 and inside fixed frame 24 elongated tubes 36 cooperate to receive the elongated handles (not shown) of tools, sporting equipment etc. Illustrated in FIG. 2 is how exterior cylindrical shell or bucket 22 may be replaceably removed from base 32, since it simply fits snugly within recess 64 of base 32. Illustrated in FIGS. 1 and 2 is how inside fixed frame 24 may be replaceably removed from exterior cylindrical shell or bucket 22 by simply applying an upward force onto handle 68 which is rotatably affixed to inside fixed frame 24 by means of hook screws 66. A downward force may be applied to bucket 22 by restraining or applying a downward force to bucket handle 72(see FIG. 2).

Referring now to FIG. 3 there is shown an isometric view of the base 12 of the tool implement stand 10 of FIG. 1 with the fixed internal frame 24 of implement stand 10 removed from the bucket cylindrical external frame 22 and positioned above the base, all according to the teachings of the invention. Recess 64 of base 12 is illustrated clearly in FIG. 3. It can now be clearly understood how the lower portion 42 of lower plate 32 now can fit snugly within recess 64 of base 12. It can also be understood that inside fixed frame 24 of implement stand 10 will support top plate 34 so that again implement stand 10 functions as a stand alone implement support and is mobile on base 12 even though exterior cylindrical shell frame or bucket 22 has been removed as a stand alone bucket for use at the job sight.

Referring again now to FIG. 1, there is shown that a ballast material 70 can be placed in the bottom area of bucket 22 under lower portion 42 of bottom plate 32 to provide for transporting necessary supplies to the job sight and to stabilize implement stand 10. Although any material may be transported/stored in this area, some examples, without limitation are water, dirt, fertilizer, mulch, small pieces of hardware, small hand tools etc.

I claim:

1. An upright implement stand, comprising:

a) a stand alone bucket having a frame including an external fixed annular circumferential wall, a top plate sized to fit within said external fixed annular circumferential wall, and a bottom plate sized to fit within said external fixed annular circumferential wall, said top plate having openings disposed therein for receiving lengthwise handles of implements, and both said top and bottom plates having receptacles disposed therein;

b) a multiplicity of isolation tubes having top and bottom ends for receiving and separating and storing the lengthwise handles of said implements, said isolations tubes being disposed through the openings in said top plate and received by said receptacles disposed on both said top and bottom plates to provide an upright implement stand for storing said implements in an upright position;

c) independent mobile means for transporting the upright implement stand, said mobile means including an independent mobile frame, wheels, axles and bracket housings for said axles, said mobile frame includes a base and a recess disposed on the top of said base for receiving the external fixed circumferential wall of the upright implement stand;

both said top and bottom plates are disposed horizontally in the frame; said isolation tubes are disposed vertically in said frame;

said external annular circumferential wall is a truncated cone and said bottom plate has a smaller diameter than the top plate;

said top and bottom plates and the multiplicity of tubes are rigidly attached to each other to provide a fixed internal frame, and wherein the external circumferential wall is a portion of a bucket, and wherein the bottom plate fits snugly within both the circumferential wall of said bucket and the recess of the base to provide the option of removing the internal frame from the upright implement stand to provide both an independent bucket for use on the job sight and a stand alone rigid framed upright implement stand for storing implements in the upright position;

both said bottom plate of the internal frame and the bottom circumferential wall of said bucket being sized to fit within said recess of said base to provide for transporting either said internal framed implement stand or said independent bucket at the job sight.

* * * * *